United States Patent [19]

Yamada

[11] Patent Number: 4,880,263

[45] Date of Patent: Nov. 14, 1989

[54] SWITCHING APPARATUS FOR VEHICLE LOCKING DEVICE

[75] Inventor: Shinjiro Yamada, Utsunomiya, Japan

[73] Assignee: Mitsui Kinzoku Kogyo Kabushiki Kaisha, Tokyo, Japan

[21] Appl. No.: 230,969

[22] Filed: Aug. 11, 1988

[51] Int. Cl.[4] ..... E05C 3/24

[52] U.S. Cl. ..... 292/216; 292/201; 200/61.62; 200/61.64

[58] Field of Search ..... 292/201 X, 216 X, 280, 292/341.16; 200/61.62 X, 61.64 X

[56] References Cited

U.S. PATENT DOCUMENTS

| | | | |
|---|---|---|---|
| 3,667,791 | 6/1972 | Kazaoka et al. | 292/216 |
| 3,667,792 | 6/1972 | Torii | 292/216 |
| 3,905,627 | 9/1975 | Fujita | 292/216 |
| 4,249,161 | 2/1981 | Mohnhaupt | 200/61.64 |
| 4,452,058 | 6/1984 | Noel | 292/201 |
| 4,518,182 | 5/1985 | Cousin et al. | 292/216 |
| 4,814,557 | 3/1989 | Kato | 200/61.64 |

FOREIGN PATENT DOCUMENTS

| | | |
|---|---|---|
| 58-64629 | 5/1981 | Japan . |
| 59-13555 | 6/1984 | Japan . |

*Primary Examiner*—Gary L. Smith
*Assistant Examiner*—Michael J. Milano
*Attorney, Agent, or Firm*—Browdy and Neimark

[57] ABSTRACT

The disclosure relates to a switching apparatus for a vehicle locking device, and particularly to a switching apparatus which can electrically detect the state of a latch in a vehicle locking device. The switching apparatus detects whether the latch is in an open state, half-latched state or fully-latched state.

1 Claim, 6 Drawing Sheets

SWITCHING APPARATUS FOR VEHICLE LOCKING DEVICE

FIELD OF THE INVENTION

The present invention relates to a switching apparatus for a vehicle locking device, and particularly to a switching apparatus which can electrically detect the state of a latch in a vehicle locking device.

PRIOR ART

The known technique described in the specification of Japanese Utility Model Laid-Open No. 64629/1981 incorporates a movable contact point provided on a latch on the door of a vehicle which engages with a striker fixed to the vehicle body and rotates, as well as a fixed contact point having the form of a circular arc with its center at the axis of the latch and provided on a base plate made of a synthetic resin. This arrangement allows the half-latched state and the fully-latched state to be electrically detected by the degree of the rotation of the latch, the detected state being indicated by means of a warning lamp or an alarm.

Japanese Utility-Model Laid-Open No. 13555/1984 and many other publications also describe inventions and devices which make use of the changes in the peripheral shape of a latch for the purpose of detecting a half-latched state and a fully-latched state.

PROBLEM TO BE SOLVED BY THE INVENTION

Although the technique described in Japanese Utility-Model Laid-Open No. 64629/1981 comprises a fixed contact point which has the form of a circular arc with its center at the axis of the latch and which is provided on the base plate made of a synthetic resin, some practical problems still remain to be solved. In addition, although the fixed contact point having the form of a circular arc is provided on the base plate made of a synthetic resin, a spring for reversing the latch must be provided at the very position of the contact point, and there is an unsolved problem with respect to the mounting of the movable contact point.

Although Japanese Utility-Model Laid-Open No. 13555/1984 and the various other publications utilize the peripheral shape of the latch for the purpose of detecting a half-latched state and a fully-latched state, a problem remains with respect to the mounting of a fixed switch and a movable switch.

DETAILED DESCRIPTION OF THE INVENTION

Figure 1:
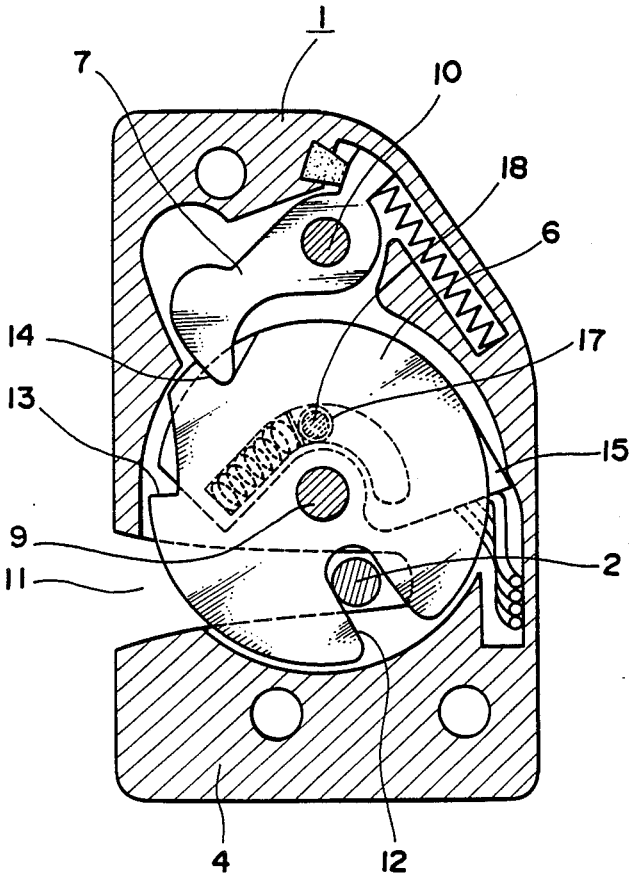
FIG. 1 is a sectional view of a principal portion of a locking device of the present invention.
Figure 2:
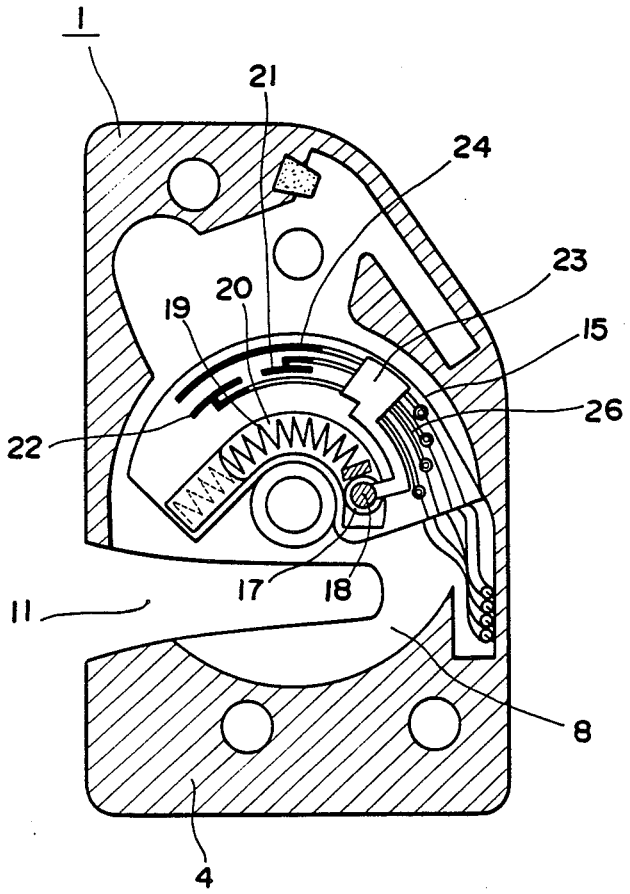
FIG. 2 is a sectional view of the locking device shown in FIG. 1 with a latch, a ratchet and a cartridge cover removed.
Figure 3:
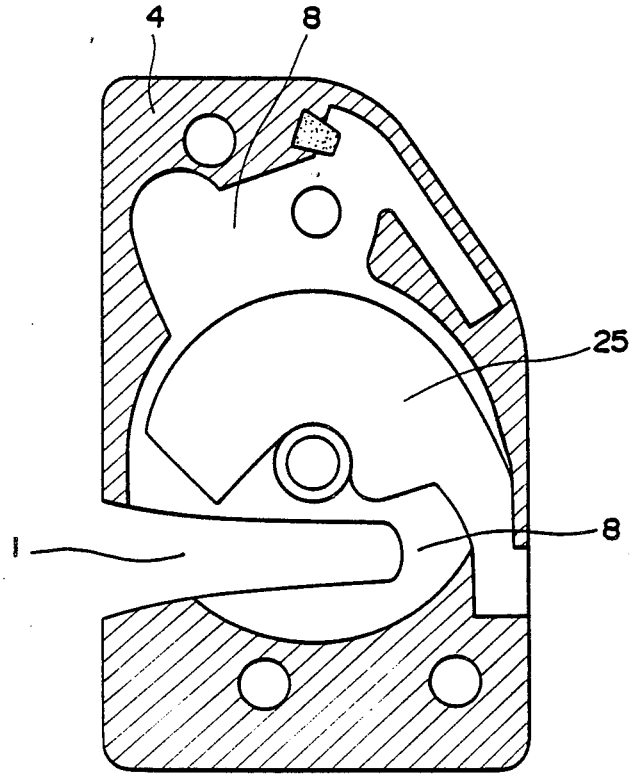
FIG. 3 is a sectional view of the same locking device with the cartridge shown in FIG. 2 removed.
Figure 4:
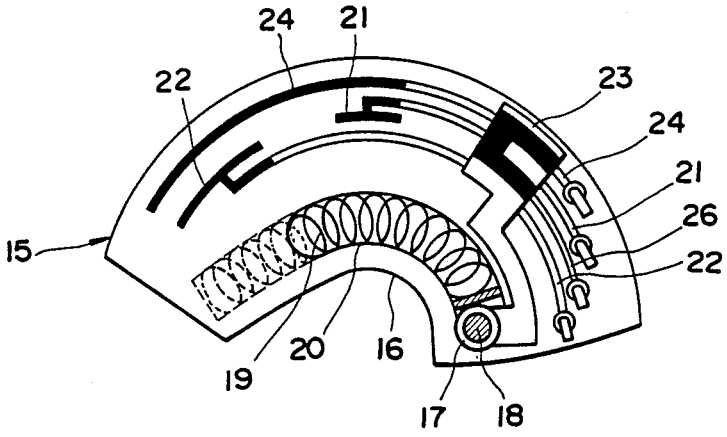
FIG. 4 is a sectional view of the cartridge with the cover removed.
Figure 5:
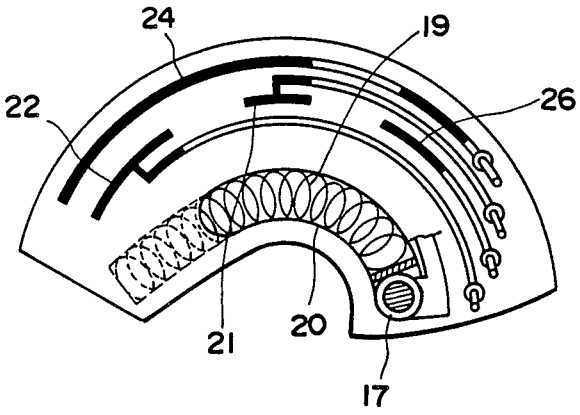
FIG. 5 is a sectional view of the cartridge shown in FIG. 4 with the cover and part of a movable contact point removed.
Figure 6:
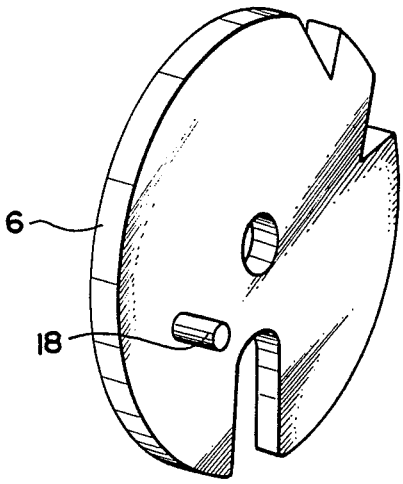
FIG. 6 is a perspective view of a latch.
Figure 7:
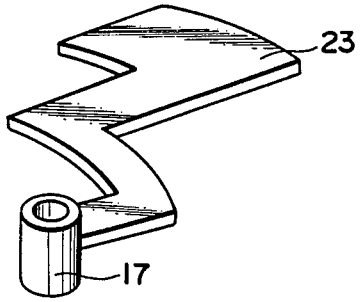
FIG. 7 is a perspective view of a movable contact point.
Figure 8:
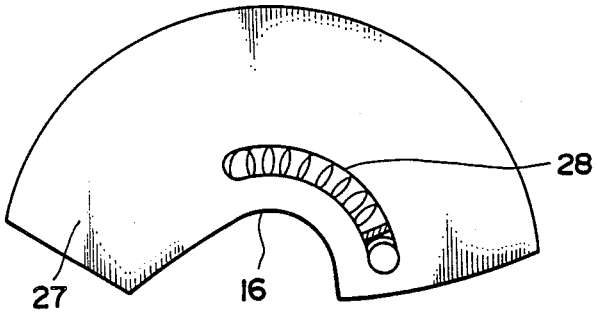
FIG. 8 is a side view of the cartridge.
Figure 9:
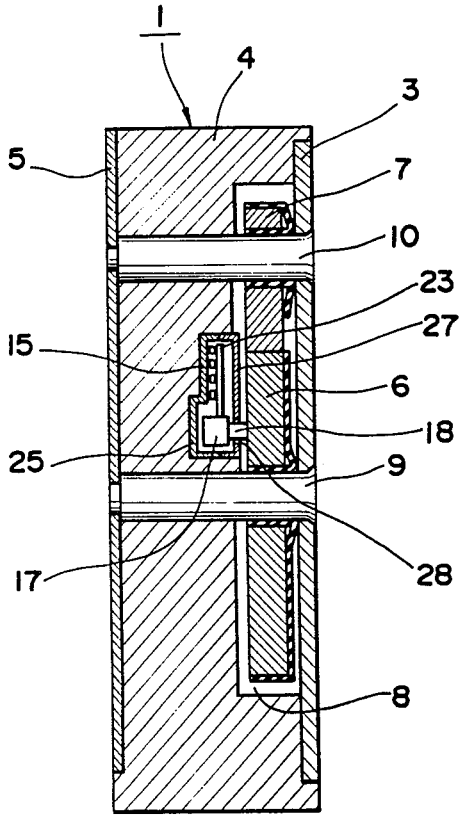
FIG. 9 is a longitudinally sectional side view of the locking device.

An embodiment of the present invention is described below with reference to the drawings In the drawings, reference numeral 1 denotes a locking device and reference numeral 2 denotes a striker provided on the vehicle side, the locking device 1 having a triple structure comprising a metal cover plate 3, a base plate 4 made of a synthetic resin and a metal back plate 5.

A recess portion 8 in which are received a latch 6 and a ratchet 7 which engages with the latch 6 to prevent it from reversing is formed in the base plate 4 made of a synthetic resin.

The latch 6 and the ratchet 7 are pivotally supported by shafts 9 and 10, respectively. Reference numeral 11 denotes an approach groove for the striker 2. An engagement groove 12 which engages with the striker 2, a half-latching stage 13 and a fully-latching stage 14 which engage with the ratchet 7 are formed on the periphery of the latch 6.

A recess portion 25 for receiving a cartridge is provided at the back of the recess portion 8, a cartridge 15 being mounted in the recess portion 25.

A boss 17 in which is inserted a projection 18 projecting from the latch 6 is provided on the side of the cartridge 15 that is adjacent to the internal periphery 16 thereof so as to engage with an inner groove 20 having the shape of a circular arc with its center coinciding with the latch shaft 9 and being formed in the cartridge 15.

A return spring 19 for reversing the latch 6 also engages with the arc-shaped inner groove 20 and the boss 17 engages with one end of the return spring 19 for the latch 6.

A half-latching fixed contact 21, a fully-latching fixed contact 22, a fixed contact 24 for earthing and an open-state fixed contact 26 are concentrically provided on the outer side of the arc-shaped inner groove 20 in the cartridge 15. The fixed contact 24 for earthing does not need to be provided in some cases.

A movable contact 23 which projects from and is integral with the boss 17 is brought into slidable contact with each of the fixed contacts.

Reference numeral 27 denotes a cover of the cartridge 15 and reference numeral 28 denotes a slit provided in the cover 27, the boss 17 being movable in the slit 28.

FUNCTION OF THE INVENTION

In the present invention, when the cartridge 15 is engaged in the recess portion 25 which is provided at the back of the recess 8 in the synthetic resin base plate 4, the cartridge 15 is engaged at a given position determined by the design thereof, and the arc-shaped inner groove 20, the return spring 19 which is provided in the arc-shaped inner groove 20, the half-latching fixed contact 21, the fully-latching fixed contact 22, the fixed contact 24 for earthing, and the open-state fixed contact 26 are all concentrically positioned with the shaft 9 as the center.

When the latch 6 is then fitted over the shaft 9 in the recess portion 8 so that the projection 18 projecting from the latch 6 is engaged with the boss 17 of the cartridge 15, and the ratchet 7 is fitted over the shaft 10 in the recess 8, the mounting is completed.

In this state, if a door is closed, the striker 2 on the vehicle body side is engaged with the engagement groove 12 of the latch 6 on the door side so that the latch 6 is rotated. When the latch 6 is rotated, the boss 17 with which the projection 18 of the latch 6 engages is moved so that the movable contact 23 integrally provided on the boss 17 is also moved. At the time of half-latched state where the ratchet 7 is engaged with the half-latching stage 13, since the latch 6 is rotated to an intermediate position, the fixed contact 24 for earthing and the half-latching fixed contact 21 are short-circuited by the movable contact 23 to correctly detect the half-latched state.

At the time of fully-latched state where the ratchet 7 is engaged with the fully-latching stage 14, since the latch 6 is rotated to the final position, the open-state fixed contact 24 and the fully-latching fixed contact 22 are short-circuited by the movable contact 23 to correctly detect the fully-latched state.

At the time when the door is open, the fixed contact 24 for earthing and the open-state fixed contact 26 are short-circuited to display the open state.

EFFECT OF THE INVENTION

As described above, the present invention exhibits the following effects:

(1) Since the recess portion 25 for receiving the cartridge 15 is provided at the back of the recess 8 for receiving the latch so that the cartridge 15 is received therein, the work of assembly is easy.

(2) Since the half-latching fixed contact 21, the fully-latching fixed contact 22 and the open-state fixed contact 26 which each have a circular form with the latch shaft 9 as the center, the arc-shaped inner groove 20, the return spring 19 which is received in the arc-shaped inner groove 20, and the movable contact 23 which is brought into contact with each of the fixed contacts are provided in the cartridge 15, an accurate operation is provided.

(3) The return spring 19 for reversing the latch are separated from the fixed contacts.

I claim:

1. A switching apparatus for a vehicle locking device in which a recess portion 8 for receiving a latch 6 and a ratchet 7 for preventing the reversing of said latch is formed in a base plate 4 made of a synthetic resin so that said latch 6 and said ratchet 7 are mounted in said recess portion 8, comprising a recess portion 25 for receiving a cartridge 15 which is provided at the back of said recess portion 8, said cartridge 15 being provided with a half-latching fixed contact 21, a fully-latching fixed contact 22 and an open-state fixed contact 26 which each have the form of a circular arc with a latch shaft 9 at the center of the arc, an arc-shaped inner groove 20, a return spring 19 for reversing said latch which is received in said arc-shaped inner groove 20, and a movable contact 23 which is brought into contact with each of said fixed contacts and which has a boss 17 engaging with one end of said return spring 19 in said arc-shaped inner groove 20, said latch 6 being received in said recess 8 after said cartridge 15 has been received in said recess 25 so that a projection 18 projecting from said latch 6 is engaged with said boss 17 of said movable contact 23 of said cartridge 15.

* * * * *